US005950653A

United States Patent [19]

Folsom

[11] Patent Number: 5,950,653

[45] Date of Patent: Sep. 14, 1999

[54] HIGH PRESSURE RELIEF VALVE FOR USE WITH A BACKFLOW PREVENTER

[76] Inventor: William D. Folsom, 21703 Rotherdam Dr., Spring, Tex. 77388

[21] Appl. No.: 09/049,832

[22] Filed: Mar. 27, 1998

[51] Int. Cl.[6] ..... F16K 17/04

[52] U.S. Cl. ..... 137/14; 137/115.13; 137/115.18; 137/218; 137/334; 137/512.3

[58] Field of Search ..... 137/115.13, 115.18, 137/218, 512.3, 14, 334

[56] References Cited

U.S. PATENT DOCUMENTS

| | | | |
|---|---|---|---|
| 4,044,787 | 8/1977 | Sutherland | 137/107 |
| 4,090,527 | 5/1978 | Sutherland | 137/215 |
| 4,241,752 | 12/1980 | Ackroyd | 137/107 |
| 4,249,556 | 2/1981 | Waletzko | 137/107 |
| 4,276,897 | 7/1981 | Griswold | 137/218 |
| 4,489,746 | 12/1984 | Daghe et al. | 137/218 |
| 4,506,694 | 3/1985 | Daghe et al. | 137/218 |
| 4,553,563 | 11/1985 | Daghe et al. | 137/494 |
| 4,658,852 | 4/1987 | Weingarten | 137/218 |
| 5,299,592 | 4/1994 | Swanson | 137/881 X |
| 5,551,473 | 9/1996 | Lin et al. | 137/218 |
| 5,682,920 | 11/1997 | De'Longhi | 137/513.2 X |

*Primary Examiner*—Gerald A. Michalsky
*Attorney, Agent, or Firm*—Mary J. Gaskin

[57] ABSTRACT

A backflow preventer assembly installed between a supply line and a service line, comprising one or more check valves and a high pressure relief valve operating to discharge water in the service line under a high pressure condition.

5 Claims, 3 Drawing Sheets

HIGH PRESSURE RELIEF VALVE FOR USE WITH A BACKFLOW PREVENTER

FIELD OF THE INVENTION

The present invention relates to a high pressure relief valve for use with a backflow preventer apparatus. The valve will drain the water system on the downstream side of the backflow preventer apparatus when a high pressure problem or a back pressure problem occurs.

BACKGROUND OF THE INVENTION

Backflow in a water distribution system can cause contamination of the potable water supply. Backflow can be caused by back siphonage when the pressure in the potable supply pipe or main drops, creating a vacuum, which causes a backflow of possibly contaminated liquid from the service pipe. Backflow can also result from back pressure, when the pressure in the service pipe exceeds that in the potable supply pipe.

Control of both types of backflow requires installation of an air gap when feasible or a backflow-prevention assembly. An air gap eliminates backflow, but it can be bypassed. Backflow-prevention assemblies of several types are also used. Two common types of assemblies are the reduced-pressure assemblies (RPBA's) and the double check valve assemblies (DCVA's). Commonly used to prevent health hazards, RPBA's have two independent check valves, with a pressure differential relief valve located between them. Contamination of the potable water supply is prevented by draining the chamber between the check valves. Double check valve assemblies (DCVA), commonly used with non-health hazards, have two check valves between two shutoff valves. A RPBA or DCVA is installed at the inlet to the service connection.

The presently available backflow prevention devices stop the reverse flow of water during a situation involving negative pressure conditions in the main water supply. However, the presently available devices are not effective in relieving high pressure conditions. For instance, when a water heater relief valve fails, the expansion of overheated water causes backflow of water in the water service line. This will cause the RPBA or DCVA to close; then, if the pressure continues to rise, the water heater may explode.

SUMMARY OF THE INVENTION

The present invention describes a high-pressure relief valve which is designed to function with double check valves or independent check valves. The invention is equipped with test cocks for periodic testing and maintenance. The invention is described for use with residential water service lines, but it may be used on commercial service lines as well. It may be embodied in a unitary backflow prevention device, or it can be installed as a separate relief valve to operate in conjunction with a previously-installed backflow preventer assembly.

During normal flow conditions, the high pressure relief valve remains closed and the check valve or valves remain open. If back siphonage occurs (water pressure drops in the water supply line, causing the backflow of water from the service line), the check valve or valves will close and prevent the backflow of water into the potable water supply line. If back pressure occurs (water pressure in the service line exceeds the water pressure in the supply line), a backflow prevention assembly with a differential relief valve will operate normally. However, if a predefined high pressure condition arises (i.e., 125 p.s.i. or greater) on the service line side of the backflow preventer, the check valve or valves will close and the high pressure relief valve will open, relieving the pressure from the service line.

It is an object of the present invention to provide a device for relieving high pressure in the service line of a water system.

Another object of the invention is to provide a back up system to water heater relief valves and to protect against potential explosions.

Yet another object of this invention is to eliminate the necessity of expansion tanks sometimes used with present backflow preventers.

Still another object of this invention is to protect service line fixtures and equipment from potentially damaging pressure surges from the main supply line.

Another object of this invention is to provide an assembly which is easy to maintain and which is easy to test periodically, as required by water providers.

DESCRIPTION OF THE PREFERRED EMBODIMENT

Figure 1:
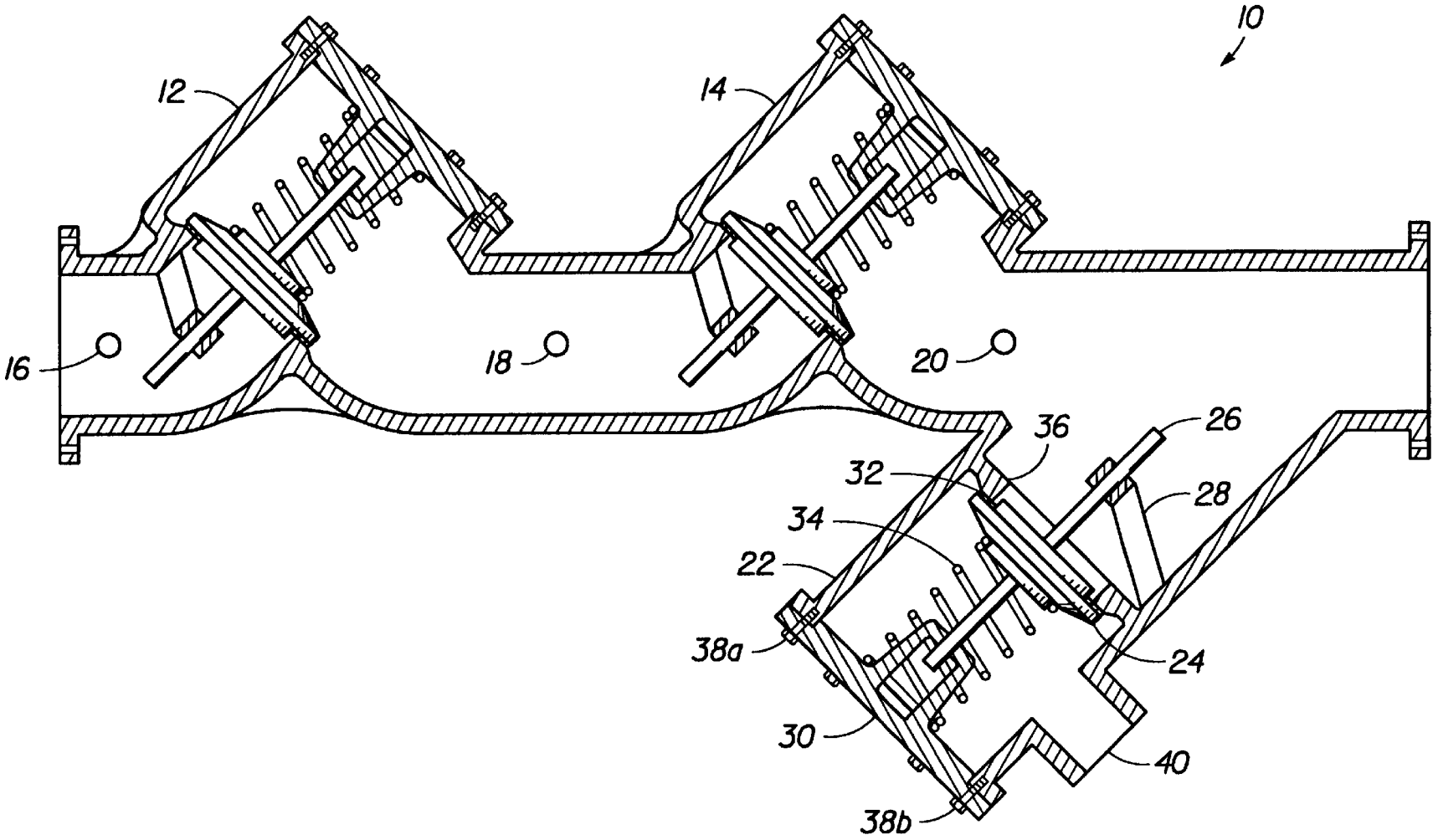
FIG. 1 is a longitudinal sectional view of the unitary backflow preventer apparatus and high pressure relief valve according to the present invention.

The high pressure relief valve of the present invention is designed to work in conjunction with a double check valve backflow preventer as shown in FIG. 1. The assembly 10 has a brass housing that can be installed in either a copper water pipe system or a polyvinyl chloride (PVC) water pipe system. First check valve 12 and second check valve 14 are set at a pre-determined water pressure to allow water to flow through the apparatus as long as the water pressure of the main water supply is adequately maintained (less than a 10 p.s.i. drop). The flow of water through the backflow preventer assembly 10 can be tested by the water provider at first test port 16, second test port 18, and third test port 20.

The high pressure relief valve 22 of the present invention, constructed of brass fittings, is mounted in a reverse flow direction from the first and second check valves 12, 14. The high pressure relief valve 22 has a disk 24 mounted on a stem 26. The stem 26 is mounted so that its vertical movement is controlled by guide 28 and retainer housing 30. A neoprene rubber washer 32 is mounted to the top side of the disk 24. A spring 34, typically made of stainless steel, is mounted to bias the disk 24 against the housing 36. Tension on the spring 34 keeps the rubber washer 32 seated against the housing 36. Bolts 38*a* and 38*b* allow removal of the retainer housing 30 for repairing the spring 34 (if tension decreases) and for servicing the high pressure relief valve 22.

The backflow preventer assembly 10 is designed to be mounted approximately 12 inches above the ground, for easy access and servicing. In application, the tension of the spring 34 is set at a much higher pressure than the springs in the first and second double check valves 12, 14, (for example, 125 p.s.i.). Should a high pressure problem arise, water will be discharged through liquid relief port 40, which has a flat surface to prevent attachment of any hose or line.

Figure 2:
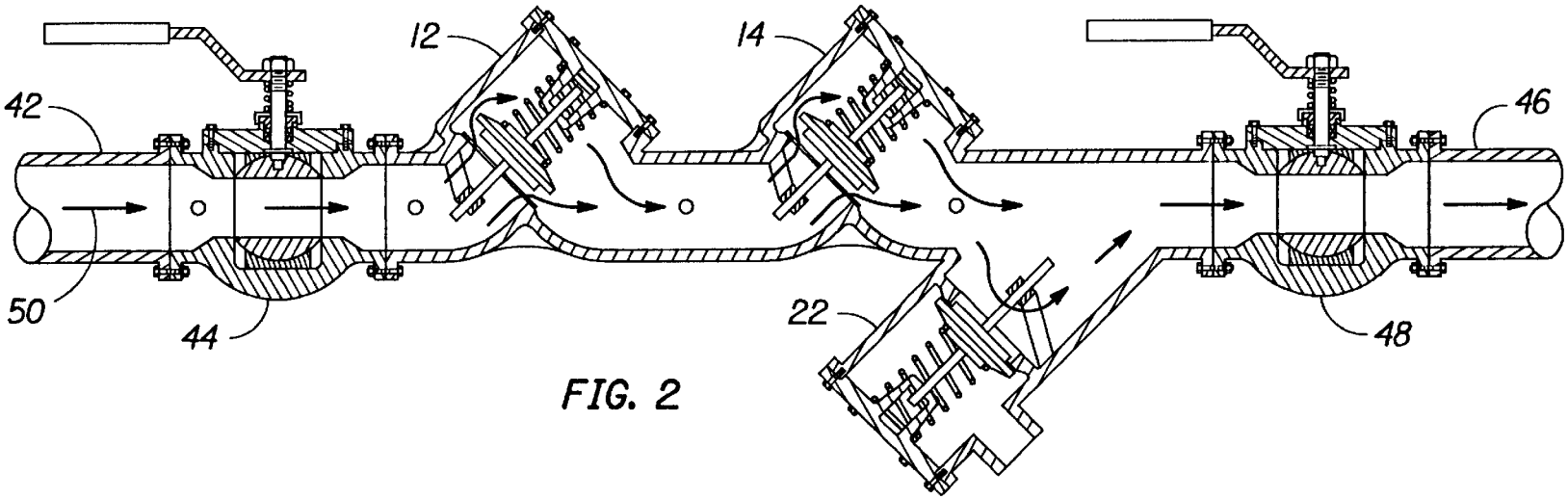
FIG. 2 is a longitudinal sectional view of a supply line showing the normal flow of water through the backflow preventer apparatus with the high pressure relief valve of the present invention.

FIG. 2 shows the normal flow line 50 for water through the assembly 10 (in the direction of the arrow). Water enters from the supply pipe 42. First shutoff ball valve 44 is mounted on the supply pipe 42 in front of the assembly 10 to provide a method of shutting off the flow of water 50 from the supply pipe 42. Water flows through first check valve 12 and second check valve 14, past the high pressure relief valve 22. A second shutoff ball valve 48 is mounted behind the assembly 10 on the service pipe 46 to provide a method of shutting off the system for testing. The service pipe 46 carries water into a water consumer's home.

Figure 3:
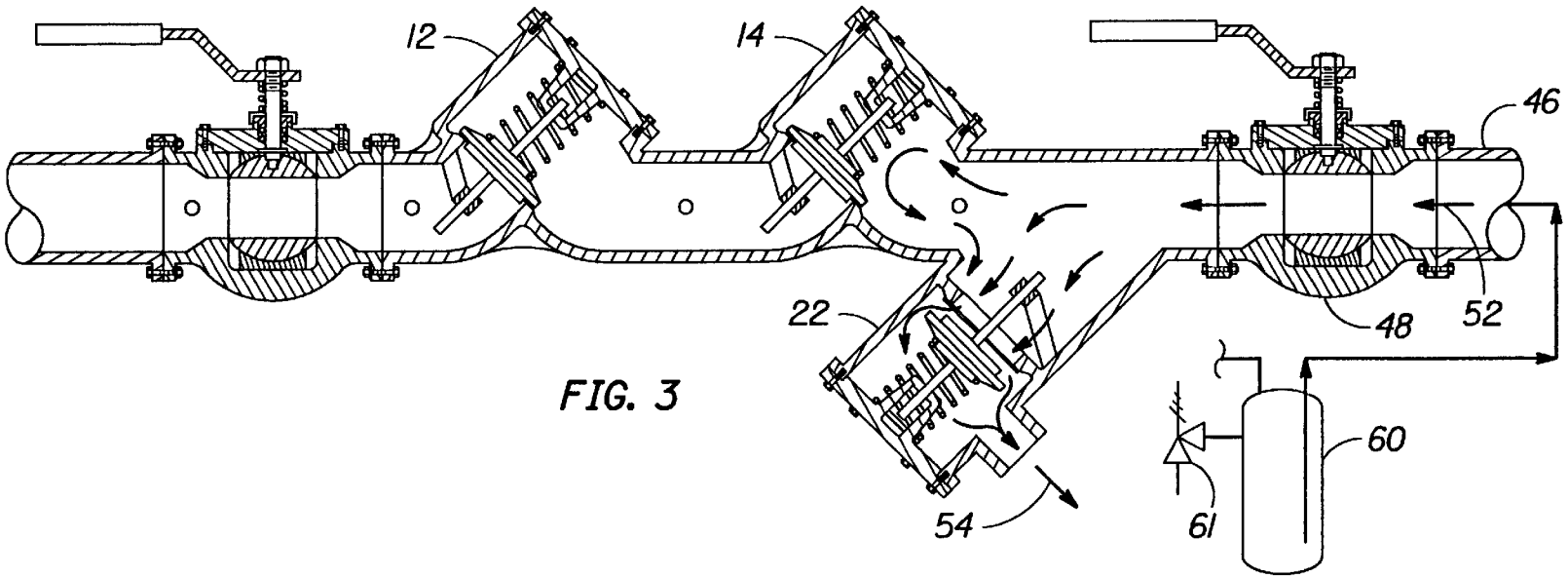
FIG. 3 is a longitudinal sectional view of a supply line showing the reverse flow of water when a back pressure or high pressure problem occurs.

FIG. 3 shows the operation of the assembly 10 if a high pressure problem arises in the service pipe 46. The reverse flow line 52 of water from the service pipe 46 would result if, for instance, a consumer's water heater 60 relief valve 61 fails, causing backflow of heated water at high pressure. The first and second double check valves 12 and 14 would close first. If pressure continues to build in the system, the pressure will be applied against the disk 24. When the pressure in the system exceeds the relief valve setting (example, 125 p.s.i.), the high pressure relief valve 22 will open, and the pressure will be released to the outside, as shown by flow arrow 54.

Figure 4:
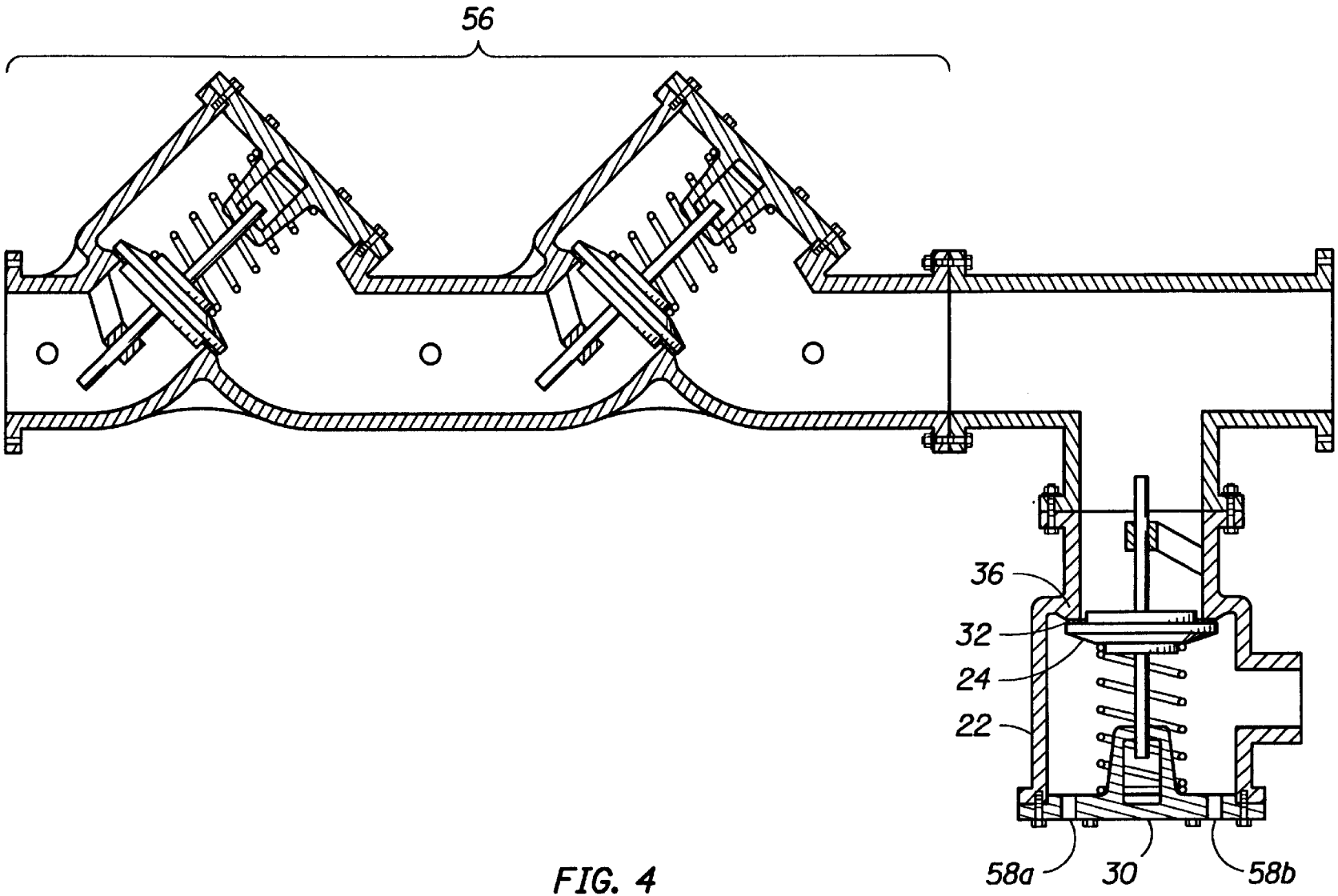
FIG. 4 is a longitudinal sectional view of a high pressure relief valve which can be mounted onto a previously-installed backflow preventer.

FIG. 4 shows the high pressure relief valve 22 mounted on a pre-installed back flow preventer device 56, which is normally designed for use in reduced pressure situations. When the high pressure relief valve 22 is mounted with the retainer housing 30 parallel to the ground, drainage holes 58*a* and 58*b*, cut through the retainer housing 30, allow drainage of any water which has seeped past the seal created where rubber washer 32 is seated against the housing 36.

The invention as described is designed for use primarily on residential water service lines, but it can be used for commercial applications as well.

I claim:

1. A backflow preventer assembly comprising:

a housing for passage of water between a supply pipe and a service pipe;

at least one check valve in said housing;

a water heater in fluid communication with said service pipe, said water heater having a pressure relief valve susceptible to failure;

a relief valve assembly installed in said housing downstream of said check valve disposed in a reverse flow direction, said relief valve assembly having dimensions sufficiently large enough to empty said service pipe and further having a port open to outside atmosphere and a back-up relief valve operable to open position automatically in response to a predetermined high pressure condition in said service pipe which was not relieved due to a failure of said water heater pressure relief valve, which condition first causes said check valve to close and then causes said back-up relief valve to open, thereby discharging water under high pressure to the outside atmosphere through said port.

2. The backflow preventer assembly of claim 1 wherein said housing includes a valve seat for said back-up relief valve, said back-up relief valve being spring-urged to a closed position on the valve seat.

3. The backflow preventer assembly of claim 2 wherein said back-up relief valve comprises a stem, a disc-shaped member with a washer mounted on said stem, and a spring mounted to bias said disc-shaped member against said valve seat.

4. A method for relieving a high pressure condition in a water pipe caused by high pressure downstream comprising:

installing a relief valve assembly downstream from at least one check valve in a housing for passage of water between a supply pipe and a service pipe, and upstream from a water heater having a pressure relief valve susceptible to failure;

1. installing a relief valve assembly downstream from at least one check valve in a housing for passage of water between a supply pipe and a service pipe, and upstream from a water heater having a pressure relief valve susceptible to failure;

2. installing a back-up relief valve in said relief valve assembly, said back-up relief valve being moveable between a closed and an open position;

3. providing means for controlling said back-up relief valve so that said back-up relief valve automatically opens in response to a predetermined high pressure condition arising in said service pipe, which condition was not relieved due to a failure of said water heater pressure relief valve and which condition has first caused said check valve to close;

4. providing a port in said relief valve assembly, said port being open to the atmosphere so that said high pressure condition can be relieved.

5. A method according to claim 4 wherein said high pressure is relieved, thereby preventing an explosion of said water heater.

* * * * *